United States Patent [19]

Pirez et al.

[11] Patent Number: 5,034,626

[45] Date of Patent: Jul. 23, 1991

[54] BIMOS CURRENT BIAS WITH LOW TEMPERATURE COEFFICIENT

[75] Inventors: Yolanda M. Pirez, Miami; Kha H. Le, Ft. Lauderdale, both of Fla.

[73] Assignee: Motorola, Inc., Schaumburg, Ill.

[21] Appl. No.: 583,750

[22] Filed: Sep. 17, 1990

[51] Int. Cl.[5] ..... G05F 3/28

[52] U.S. Cl. ..... 307/296.7; 307/310; 323/315; 323/316; 323/907

[58] Field of Search ..... 307/296.6, 296.7, 310; 330/288; 323/315, 316, 317, 907, 312; 338/9

[56] References Cited

U.S. PATENT DOCUMENTS 4,029,974 6/1977 Brokaw ..... 307/296.6
4,419,594 12/1983 Gemmel et al. ..... 323/315
4,450,367 5/1984 Whatley ..... 307/296.8
4,780,624 10/1988 Nicollini et al. ..... 307/446
4,853,610 8/1989 Schade, Jr. ..... 323/316
4,890,052 12/1989 Hellums ..... 323/315
4,943,737 6/1990 Guo et al. ..... 307/296.6

*Primary Examiner*—Stanley D. Miller
*Assistant Examiner*—Scott A. Ouellette
*Attorney, Agent, or Firm*—Juliana Agon

[57] ABSTRACT

A current bias generator (10) with a low temperature coefficient sums the currents (13 and 16) from a bipolar current generator (12) and a MOS current generator (14) having opposite temperature coefficients to provide a low temperature coefficient bias current.

8 Claims, 1 Drawing Sheet

BIMOS CURRENT BIAS WITH LOW TEMPERATURE COEFFICIENT

TECHNICAL FIELD

This invention relates generally to a circuit for biasing BIMOS integrated devices and more specifically to a circuit utilizing both bipolar and MOS devices for generating a low temperature bias current to be used as a reference bias current for other circuits.

BACKGROUND

Any electrical circuit that uses a transistor as an amplifier needs to bias the transistor at some operating point so that the device is in the active region. The current through the device or the voltage applied to the transistor device will determine this operating or bias point. Over temperature, the bias point also needs to be maintained by a stable bias current, so that the design characteristics will also remain within the specified design limits.

Conventional circuits employing only bipolar transistors to generate the temperature stable bias current are generally well known in the prior art. Because the voltage $V_{BE}$ across the base-emitter junction of a bipolar transistor has a negative temperature coefficient, the currents derived from this voltage inevitably will also have the same negative characteristic. Due to higher density and lower power consumption, MOS is the technology of choice in today's IC circuits. However, the threshold voltage $V_T$ of a MOS transistor, which is the equivalent of $V_{BE}$ in bipolar technology, has a positive temperature coefficient from which to derive currents.

It would therefore be desirable to provide a merged or composite bipolar/MOS circuit which combines the advantages of bipolar and MOS technologies together. As a result bipolar transistors and MOSFET transistors are merged or are arranged in a common semi-conductor substrate in order to form an integrated circuit which can give a precise control of bias current over temperature and can be manufactured at a relatively low cost but yet provides a much improved performance.

SUMMARY OF THE INVENTION

Accordingly, it is an object of the present invention to provide a bipolar/MOS (BIMOS) circuit to generate a bias current with a low temperature coefficient.

Briefly, according to the invention, a current bias generator with a low temperature coefficient sums the currents from a bipolar current generator and a MOS current generator having opposite temperature coefficients to provide a low temperature coefficient bias current.

DETAILED DESCRIPTION OF THE PREFERRED EMBODIMENT

Figure 1:
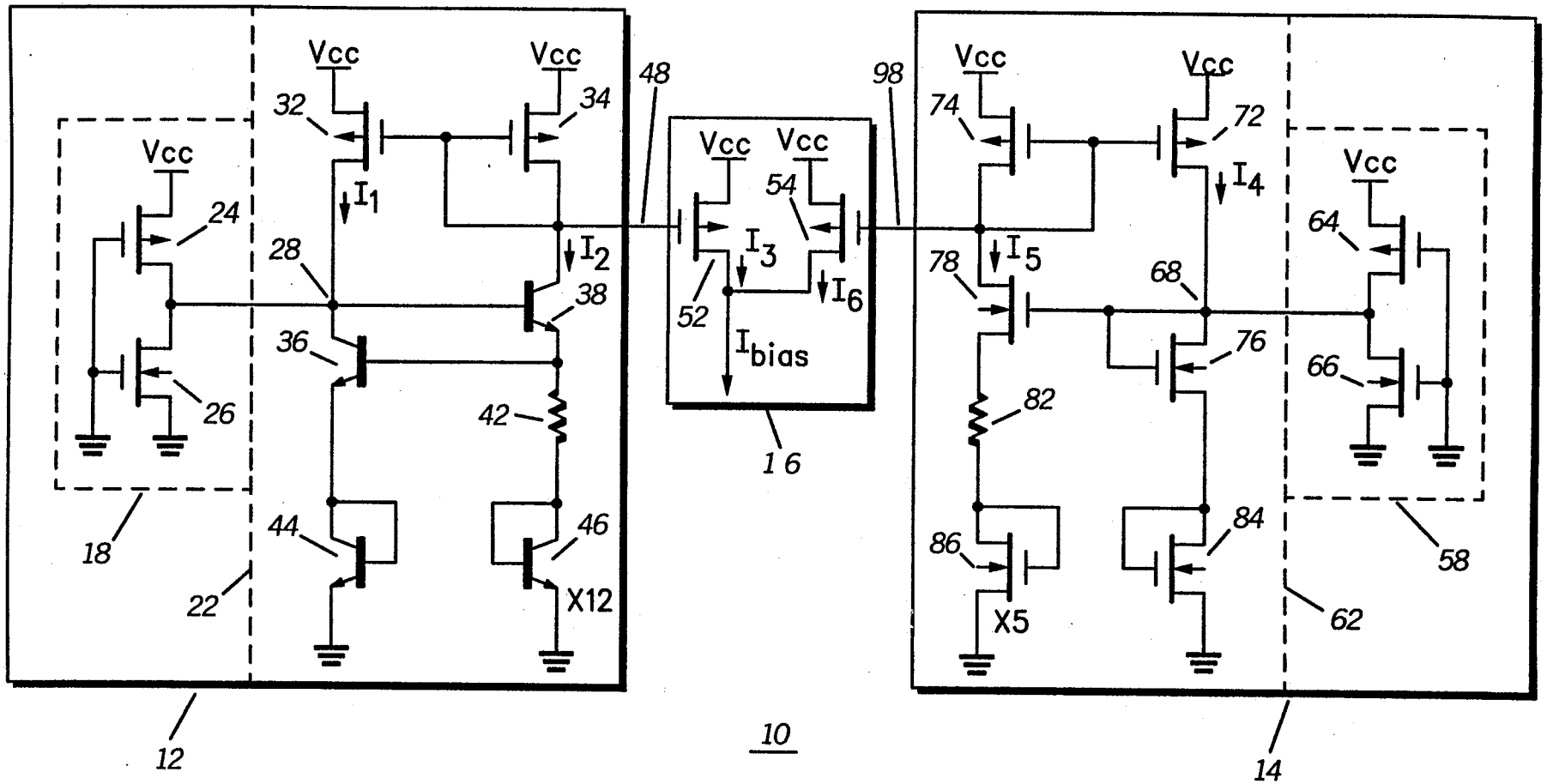
FIG. 1 is a circuit diagram of a biasing circuit according to the invention.

Referring to FIG. 1, there is shown a schematic circuit diagram of a BIMOS (bipolar/MOS) current bias generator with a low temperature coefficient in accordance with the present invention for generating a bias current $I_{bias}$ which varies favorably with temperature and process corners. The bias current $I_{bias}$ may be used as a reference bias current to any other circuits that requires a stable bias current over temperature. The present invention is especially useful for low power operations because of the smaller current drawn by the smaller devices occupying a smaller area due to MOS technology. The current bias generator with low temperature coefficient 10 is comprised of a bipolar current generator 12 having a temperature slope, a MOS current generator 14 having a temperature slope of the opposite direction from the bipolar current generator 12, and summing means 16 which adds the outputs of each of the current generators 12 and 14 together to cancel most of the current variation with temperature. The currents of the two current generators 12 and 14 are set or defined such that their temperature deviations cancel each other out.

The bipolar current generator 12 includes a start-up current section 18 and a current source 22. The start-up current section 18 is formed of a P-channel MOS transistor (or MOSFET) 24 and an N-channel MOS transistor 26. The transistor 24 has its source electrode connected to a power supply voltage or potential VCC. Both transistors 24 and 26 have their drain electrodes connected together to an input 28 of the current source 22, and their gate electrodes connected together to a ground potential. The source electrode of the MOSFET 26 is also connected to the ground potential.

The current source 22 includes a current mirror pair of P-channel MOSFETs 32 and 34, a pair of NPN bipolar transistors 36 and 38, a resistor 42, and a pair of diode-connected NPN transistors 44 and 46. Both transistors 32 and 34 have their source electrodes connected to the power supply voltage or potential VCC. In addition, both transistors 32 and 34 have their gate electrodes connected together to a first input 48 of the summing means 16, the drain of the transistor 34, and the collector of the transistor 38. At the input 28 of the current source 22, the gate of the transistor 38 is connected to the drain of the MOSFET 32 and to the collector of the transistor 36. The emitter of the transistor 38 is connected to the base of the transistor 36 and to one end of the resistor 42. Both the emitter of the transistor 36 and the other end of the resistor 42 are connected, respectively, to one of the diode connected transistors 44 and 46 having their emitters grounded.

Basically, the MOS current generator 14 is simply a MOS version of the bipolar current generator 12. The MOS current generator 14 includes a start-up current section 58 and a current source 62. As previously described, the start-up current section 58 is formed of a P-channel MOS transistor (or MOSFET) 64 and an N-channel MOS transistor 66. The transistor 64 has its source electrode connected to the power supply voltage or potential VCC. Both transistors 64 and 66 have their drain electodes connected together to an input 68 of the current source 62, and their gate electrodes connected together to a ground potential. The source electrode of the MOSFET 66 is also connected to the ground potential.

The current source 62 includes a current mirror pair of P-channel MOSFETs 72 and 74 (the same pair as MOSFETS 32 and 34 and connected similarly), a pair of N-channel MOS transistors 76 and 78, a resistor 82, and a pair of diode-connected N-channel MOS transistors 84 and 86. As previously described, both transistors 72 and 74 have their source electrodes connected to the power supply voltage or potential VCC. In addition, both transistors 72 and 74 have their gate electrodes connected together to a second input 98 of the summing means 16, the drain of the transistor 74, and the drain of the transistor 78.

At the input 68 of the current source 62, the gate of the transistor 78 is connected to the drain of the MOSFET 72 and to the gate and drain of the transistor 76. The source of the transistor 78 to one end of the resistor 82. Both the source of the transistor 76 and the other end of the resistor 82 are connected, respectively, to one of the diode connected transistors 84 and 86 having their sources grounded.

The summing means 16 is formed by a pair of P-channel MOSFET 52 and 54 having their source electrodes connected to the supply voltage VCC and their gate electrodes forming the first 48 and second 98 inputs of the summing means 16 to have their drain electrodes connected together to provide the bias current $I_{bias}$. It should be understood that to those skilled in the art that the entire bias current generator 10 may be formed as an integrated circuit on a single semi-conductor chip.

Operationally, the two current generators 12 and 14 function similarly but have opposite temperature contributions because of the opposite temperature characteristics of the bipolar and MOS transistors. Initially, as the supply voltage VCC ramps (or starts) up, a tiny current flows through each of the MOSFETs 24 and 64 to start a current flowing through the current sources 22 and 62 by switching ON transistors 36, 38, 76, and 78.

Since the MOS transistors 32 and 34 form a current mirror, the width to length ratio 2W/L of the channel is imposed equal for the two transistors. Assuming the base currents through the transistors 36 and 38 are negligible, then the drain currents of transistors 32 and 34

$$I1=I2.$$

To ensure that the current I2 through the resistor 42 exists, the transistor 46 is scaled N times (N>1, here N=12) that of the transistor 44. Hence, the bipolar transistor 44 is a one unit transistor and the bipolar transistor 46 comprises 12 transistors all connected in parallel.

On the other hand, since the width to length ratios of the MOS transistors 72, 74, and 54 (being in a current mirror configuration) are all equal to 2W/L, the drain currents through these MOS transistors $$I4=I5=I6.$$

To ensure currents I4 equals I5, the transistors are scaled such that the MOS transistors 76 and 78 both have the same width to length ratio.

As in the bipolar case, to ensure that the current I5 through the resistor 82 exists, the transistor 86 is scaled, in this case, to be 5 times that of the transistor 84. Hence, the MOS transistor 84 is a one unit transistor device and the MOS transistor 86 comprises five N-channel MOS transistors all connected in parallel.

The width of the MOS devices determines the magnitude of the current being mirrored before the currents I3 and I6 are summed by the MOS transistors 52 and 54 to cancel the temperature contributions from each of the current generators 12 and 14. Since the width to length ratio of the MOS transistor 52, being W/L, is equal to ½ of the W/L ratio of the MOS transistor 34, the drain current of the MOS transistor 52, $$I3=\tfrac{1}{2}\times I2=\tfrac{1}{2}\times I1.$$

Hence from the bipolar current generator 12, half the current (I3=½I2) is being added to the current I4 of the MOS current generator 14 to combine and form the bias current $I_{bias}$. As a result, the bias current $$I_{bias}=\tfrac{1}{2}\times I1+I4.$$

Since the temperature coefficients of the collector currents I1 and I2 of the bipolar transistors 44 and 46 are negative and the temperature coefficients of the drain currents I4 and I5 of the MOS transistors 84 and 86 are positive, the currents from these two current generators 12 and 14 are summed in the summing means 16 to cancel or minimize the temperature effect of each of the current generators 12 and 14. By this configuration, a low temperature coefficient of approximately −350 parts per million per degree C for the entire bias current generator 10 may be achieved. Other variations of these current generators of opposite polarity may be used to optimize for a temperature stable bias current in many applications, including for use in a synthesizer inside a communication device such as a mobile or portable radio.

What is claimed is:

1. A current bias generator with a low temperature coefficient, comprising:

a bipolar current generator having a first temperature coefficient to provide a first current;

a MOS current generator having a second temperature coefficient of an opposite polarity from said first temperature coefficient of said bipolar current generator to provide a second current; and current summing means to sum said first and second currents to provide a low temperature coefficient bias current.

2. The current bias generator of claim 1 wherein said bipolar current generator comprises a bipolar current mirror amplifier.

3. The current bias generator of claim 1 wherein said MOS current generator comprises a MOS current mirror amplifier.

4. The current bias generator of claim 1 wherein said bipolar current generator includes at least one bipolar transistor.

5. The current bias generator of claim 1 wherein said MOS current generator includes at least one MOSFET transistor.

6. The current bias generator of claim 1 wherein said current generators are scaled to provide a desired magnitude of said low temperature coefficient bias current.

7. A monolithic integrated current bias generator circuit with a low temperature coefficient, comprising:

a substrate;

a bipolar current generator formed on said substrate including at least one bipolar transistor having a negative temperature coefficient to provide a first current of one polarity;

a MOS current generator formed on said substrate including at least one MOSFET having a positive temperature coefficient to provide a second current of an opposite polarity from said bipolar current generator; and MOS current summing means formed on said substrate to sum said first and second currents to provide a low temperature coefficient bias current.

8. A monolithic integrated current bias generator circuit with a low temperature coefficient for a radio, comprising:

a substrate for a radio;

a first current mirror formed on said substrate including at least one bipolar transistor having a negative temperature coefficient to provide a first current of one polarity; and a second current mirror formed on said substrate including at least one MOSFET having a positive temperature coefficient to provide a second current of an opposite polarity from said bipolar current generator and coupled to said first current mirror to sum said first and second currents to provide a low temperature coefficient bias current.

* * * * *